US012504243B2

(12) United States Patent
Muska et al.

(10) Patent No.: US 12,504,243 B2
(45) Date of Patent: Dec. 23, 2025

(54) MAGAZINE WELL ASSEMBLY

(71) Applicant: Smith & Wesson Inc., Maryville, TN (US)

(72) Inventors: Simon M. Muska, Enfield, CT (US); Brady Hoddinott, New Hartford, CT (US)

(73) Assignee: SMITH & WESSON INC., Maryville, TN (US)

( * ) Notice: Subject to any disclaimer, the term of this patent is extended or adjusted under 35 U.S.C. 154(b) by 0 days.

(21) Appl. No.: 18/745,464

(22) Filed: Jun. 17, 2024

(65) Prior Publication Data

US 2024/0418463 A1 Dec. 19, 2024

Related U.S. Application Data

(60) Provisional application No. 63/508,549, filed on Jun. 16, 2023.

(51) Int. Cl.
*F41A 3/66* (2006.01)

(52) U.S. Cl.
CPC ..... *F41A 3/66* (2013.01)

(58) Field of Classification Search
CPC ..... F41A 3/66; F41A 3/68
USPC ..... 89/33.1, 34, 138; 42/6
See application file for complete search history.

(56) References Cited

U.S. PATENT DOCUMENTS 5,900,577 A * 5/1999 Robinson ..... F41A 11/02 89/191.01
6,070,352 A 6/2000 Daigle
7,131,228 B2 11/2006 Hochstrate et al.
7,533,598 B1 5/2009 Murphy
7,810,271 B2 10/2010 Patel
8,051,595 B2 11/2011 Hochstrate et al.
8,418,390 B1 * 4/2013 Wright ..... F41A 17/38 42/49.01
8,640,372 B2 2/2014 Hochstrate et al.
8,726,554 B2 5/2014 Klassen
8,789,302 B1 7/2014 Pietrzyk
D747,427 S 1/2016 Zusman
D748,216 S 1/2016 Zusman
9,279,632 B2 3/2016 Hochstrate et al.
9,581,411 B2 2/2017 Zusman
9,612,072 B2 4/2017 Hochstrate et al.
9,766,025 B1 * 9/2017 Rood ..... F41A 17/38
9,927,193 B2 3/2018 Beasley
10,151,546 B2 12/2018 Baker et al.
10,215,517 B2 2/2019 McCallum et al.
10,401,103 B2 * 9/2019 Konev ..... F41A 17/38
10,591,234 B2 3/2020 Beasley
10,598,454 B2 3/2020 DiChario et al.
10,670,357 B2 6/2020 Baker et al.
10,677,552 B2 6/2020 Wilkinson et al.
(Continued)

FOREIGN PATENT DOCUMENTS

DE 102012109701 B4 7/2014
WO 201317907 A1 2/2013

*Primary Examiner* — Reginald S Tillman, Jr.
(74) *Attorney, Agent, or Firm* — Ballard Spahr LLP

(57) ABSTRACT

A magazine well assembly for connecting a magazine to a firearm. The magazine well assembly has a housing defining a magazine receiving space. The magazine receiving space is adapted to receive the magazine. At least one first connector is configured to removably couple the housing to a lower receiver of the firearm.

19 Claims, 17 Drawing Sheets

(56) References Cited

U.S. PATENT DOCUMENTS

| | | | | |
|---|---|---|---|---|
| 10,837,721 | B2 | 11/2020 | Ives | |
| 11,112,192 | B2 | 9/2021 | Herring et al. | |
| 2006/0026883 | A1* | 2/2006 | Hochstrate | F41C 23/16 42/75.01 |
| 2013/0180143 | A1 | 7/2013 | Delgado Acarreta | |
| 2013/0269231 | A1 | 10/2013 | Pietrzyk | |
| 2015/0316339 | A1 | 11/2015 | Young et al. | |
| 2021/0372722 | A1 | 12/2021 | Herring et al. | |
| 2024/0085127 | A1* | 3/2024 | Patel | F41A 11/02 |

* cited by examiner

MAGAZINE WELL ASSEMBLY

CROSS REFERENCE TO RELATED APPLICATION

This application is based upon and claims benefit of priority to U.S. Provisional Application No. 63/508,549, filed Jun. 16, 2023, which is hereby incorporated by reference herein.

FIELD

This disclosure relates to a magazine well assembly for connecting a magazine to a firearm.

BACKGROUND

Various manufactures may make magazines having different sizes and magazine catch interface geometries that differ greatly across magazines, even for the same cartridge. Typically, an adapter that receives different types of magazines is inserted into a magazine well to allow the firearm to accommodate different magazine types. Assembling and disassembling adapters inserted into the magazine well of the firearm may be difficult, time consuming, and require tools.

There is clearly an opportunity to improve magazine well adapters to accommodate different sizes of magazines and magazine catch interface geometries. As further disclosed herein, it would be advantageous to have a magazine well assembly that receives a predetermined magazine type and may be easily removably coupled to the lower receiver of the firearm while maintaining definitive positional control with respect to the lower receiver of the firearm.

SUMMARY

An example magazine well assembly for connecting a magazine to a firearm according to the disclosure includes a housing defining a magazine receiving space adapted to receive the magazine. At least one first connector is configured to removably couple the housing to a lower receiver of the firearm.

In an example embodiment, the magazine receiving space is adapted to receive a predetermined magazine type.

In an example embodiment, the assembly further comprises a latch. The latch is movable between a first position engaging the magazine to fix the magazine within the magazine receiving space and a second position not engaging the magazine thereby permitting removal of the magazine from the magazine receiving space. In a further example embodiment, the latch comprises a lever having a first end and a second end, the lever pivotally coupled to the housing between the first end and the second end.

In a further example embodiment, the latch is pivotally coupled to the housing via a pin. The pin configured to rotate about a first axis, the latch configured to pivot about the first axis.

In a further example embodiment, the housing has an exterior surface and defines an opening extending from the exterior surface to the magazine receiving space. The latch comprises a first engagement surface proximate to the first end. The first engagement surface comprises a projection configured to extend through the opening in the housing and into the magazine receiving space to lock with a second engagement surface on the magazine when the latch is in the first position.

In a further example embodiment, the latch further comprises a spring acting between the housing and the lever. The spring is pre-loaded to bias the second end of the lever away from the housing to pivot the latch to the first position. A force acting on the second end compresses the spring to pivot the latch to the second position.

In an example embodiment, the housing comprises polymer material.

In an example embodiment, each first connector of the at least one first connector is a female dovetail defined within an exterior surface of the housing. The female dovetail is configured to complementarily receive and engage a respective male dovetail projecting from the lower receiver.

In a further example embodiment, a first female dovetail is defined in the housing at an intersection of an upper exterior surface and a side exterior surface of the housing and a second female dovetail is defined in the housing at an intersection of a rear exterior surface and the side exterior surface of the housing.

In an example embodiment, the assembly further comprises an insert in an upper exterior surface of the housing. The insert is configured to receive a fastener to couple a bolt catch assembly to the housing and restrict movement of the magazine well assembly relative to the lower receiver.

In a further example embodiment, the insert is a threaded insert configured to receive a threaded fastener associated with a bolt catch assembly.

In an example embodiment, the housing comprises an upper exterior surface defining a recess configured to receive a locking arm of an upper receiver.

The disclosure further encompasses a combination of a magazine well assembly and a lower receiver for a firearm. The magazine well assembly comprises a housing defining a magazine receiving space adapted to receive a magazine. The housing comprising at least one first connector. The lower receiver comprises a frame comprising at least one second connector. Each second connector of the at least one second connector is configured to complementarily engage a respective first connector of the at least one first connector to removably couple the housing to the frame.

In an example embodiment, the magazine receiving space is adapted to receive a predetermined magazine type.

In a further example embodiment, the magazine well assembly further comprises a latch. The latch is movable between a first position engaging the magazine to fix the magazine within the magazine receiving space, and a second position not engaging the magazine thereby permitting removal of the magazine from the magazine receiving space.

In a further example embodiment, the latch comprises a lever having a first end and a second end. The lever is pivotally coupled to the housing between the first end and the second end.

In a further example embodiment, the latch is pivotally coupled to the housing via a pin. The pin is configured to rotate about a first axis.

The latch is configured to pivot about the first axis.

In a further example embodiment, the housing has an exterior surface and defines an opening extending from the exterior surface to the magazine receiving space. The latch comprises a first engagement surface proximate to the first end. The first engagement surface comprises a projection configured to extend through the opening in the housing and into the magazine receiving space to lock with a second engagement surface on the magazine when the latch is in the first position.

In a further example embodiment, the latch further comprises a spring acting between the housing and the lever. The spring is pre-loaded to bias the second end of the lever away from the housing to pivot the latch to the first position. A force acting on the second end compresses the spring to pivot the latch to the second position.

In an example embodiment, the housing comprises polymer material.

In an example embodiment, each first connector of the at least first one connector is a female dovetail defined within an exterior surface of the housing. Each second connector of the at least one second connector is a male dovetail projection from the frame. Each first connector of the at least one first connector is configured to complementarily receive and engage a respective second connector of the at least one second connector.

In a further example embodiment, a first female dovetail is defined in the housing at an intersection of an upper exterior surface and a side exterior surface of the housing and a second female dovetail is defined in the housing at an intersection of a rear exterior surface and the side exterior surface of the housing.

In an example embodiment, the frame defines an opening adapted to receive a bolt catch assembly.

In a further example embodiment, the magazine well assembly further comprises an insert in an upper exterior surface of the housing. The insert configured to receive a fastener associated with the bolt catch assembly to couple the bolt catch assembly to the housing and restrict movement of the magazine well assembly relative to the lower receiver.

In an example embodiment, the frame is configured to couple with an upper receiver.

In a further example embodiment, the upper receiver comprises a locking arm. The housing comprises an upper exterior surface defining a recess configured to receive the locking arm.

In an example embodiment, the frame further comprises a slot adapted to overlie the magazine receiving space. The slot is configured to receive the magazine.

The disclosure further encompasses a firearm comprising a magazine well assembly comprising a housing defining a magazine receiving space adapted to receive a magazine. The housing comprises at least one first connector. A lower receiver comprises a frame comprising at least one second connector. Each second connector of the at least one second connector is configured to complementarily engage with a respective first connector of the at least one first connector to removably couple the housing to the frame. An upper receiver is configured to connect to the lower receiver and the magazine well assembly.

In an example embodiment, the magazine receiving space is adapted to receive a predetermined magazine type.

In an example embodiment, the magazine well assembly further comprises a latch. The latch is movable between a first position engaging the magazine to fix the magazine within the magazine receiving space, and a second position not engaging the magazine thereby permitting removal of the magazine from the magazine receiving space.

In a further example embodiment, the latch comprises a lever having a first end and a second end. The lever is pivotally coupled to the housing between the first end and the second end.

In a further example embodiment, the latch is pivotally coupled to the housing via a pin. The pin is configured to rotate about a first axis. The latch is configured to pivot about the first axis.

In a further example embodiment, the housing has an exterior surface and defines an opening extending from the exterior surface to the magazine receiving space. The latch comprises a first engagement surface proximate to the first end. The first engagement surface comprises a projection configured to extend through the opening in the housing and into the magazine receiving space to lock with a second engagement surface on the magazine when the latch is in the first position.

In a further example embodiment, the latch further comprises a spring acting between the housing and the lever. The spring is pre-loaded to bias the second end of the lever away from the housing to pivot the latch to the first position. A force acting on the second end compresses the spring to pivot the latch to the second position.

In an example embodiment, the housing comprises polymer material.

In an example embodiment, each first connector of the at least first one connector is a female dovetail defined within an exterior surface of the housing. Each second connector of the at least one second connector is a male dovetail projecting from the frame. Each first connector of the at least one first connector is configured to complementarily receive and engage a respective second connector of the at least one second connector.

In a further example embodiment, a first female dovetail is defined in the housing at an intersection of an upper exterior surface and a side exterior surface of the housing and a second female dovetail is defined in the housing at an intersection of a rear exterior surface and the side exterior surface of the housing.

In an example embodiment, the firearm further comprises a bolt catch assembly. The frame defines an opening adapted to receive the bolt catch assembly.

In a further example embodiment, the magazine well assembly further comprises an insert in an upper exterior surface of the housing. The insert is configured to receive a fastener associated with the bolt catch assembly to couple the bolt catch assembly to the housing and restrict movement of the magazine well assembly relative to the lower receiver.

In an example embodiment, the upper receiver comprises a locking arm. The housing comprises an upper exterior surface defining a recess configured to receive the locking arm.

In an example embodiment, the frame further comprises a slot adapted to overlie the magazine receiving space. The slot is configured to receive the magazine.

The disclosure further encompasses a method of assembling and disassembling a magazine well assembly and a magazine. The method comprises inserting the magazine into a magazine receiving space defined by a housing of the magazine well assembly. The housing comprises at least one first connector configured to removably couple the housing to a lower receiver of a firearm. The method comprises locking the magazine to the housing with a latch. The latch comprises a spring and a lever having a first end and a second end. The lever is pivotally attached to the housing between the first end and the second end. The spring acts between the housing and the lever and biases the second end of the lever away from the housing to pivot the latch to a first position. A first engagement surface proximate to the first end of the lever comprises a projection extending through an opening in the housing and engaging a second engagement surface on the magazine when the latch is in the first position.

In an example embodiment, the method further comprises pushing the second end of the lever to compress the spring and pivot the latch to a second position. The first end of the lever pivots away from the housing until the projection disengages the second engagement surface on the magazine when the latch is in the second position.

In an example embodiment, the method further comprises removing the magazine from the magazine receiving space.

The disclosure further encompasses a method comprising attaching a first magazine well assembly to a lower receiver of a firearm by joining each first connector of at least one first connector of a housing of the first magazine well assembly to a respective second connector of at least one second connector of a frame of the lower receiver of a firearm to connect a first type of magazine within a magazine receiving space defined by the housing of the first magazine well assembly to the lower receiver.

In an example embodiment, the method further comprises removing the first magazine well assembly from the lower receiver by disengaging each first connector of the at least one first connector and the respective second connector of the at least one second connector.

In an example embodiment, the method further comprises attaching a second magazine well assembly to the lower receiver of the firearm by joining each third connector of at least one third connector of a housing of a second magazine well assembly to the respective second connector of the at least one second connector of the frame of the lower receiver of the firearm to connect a second type of magazine within a magazine receiving space defined by the housing of the second magazine well assembly to the lower receiver.

In an example embodiment, each second connector is a male dovetail and each first connector and third connector are female dovetails configured to receive the male dovetail.

In a further example embodiment, the first magazine well assembly is attached to the lower receiver of the firearm by aligning the female dovetails of the first magazine well assembly and the male dovetails of the lower receiver and moving the first magazine well assembly in a first direction along a second axis transverse to a longitudinal axis of the lower receiver until the male dovetails of the lower receiver are fully inserted in the female dovetails of the first magazine well assembly.

In a further example embodiment, the first magazine well assembly is removed by moving the first magazine well assembly in a second direction opposite to the first direction until the female dovetails of the first magazine assembly are disengaged from the male dovetails of the lower receiver.

In a further example embodiment, the second magazine well assembly is attached to the lower receiver of the firearm by aligning the female dovetails of the second magazine well assembly and the male dovetails of the lower receiver and moving the second magazine well assembly in the first direction until the male dovetails of the lower receiver are fully inserted in the female dovetails of the second magazine well assembly.

DETAILED DESCRIPTION

Figure 1:
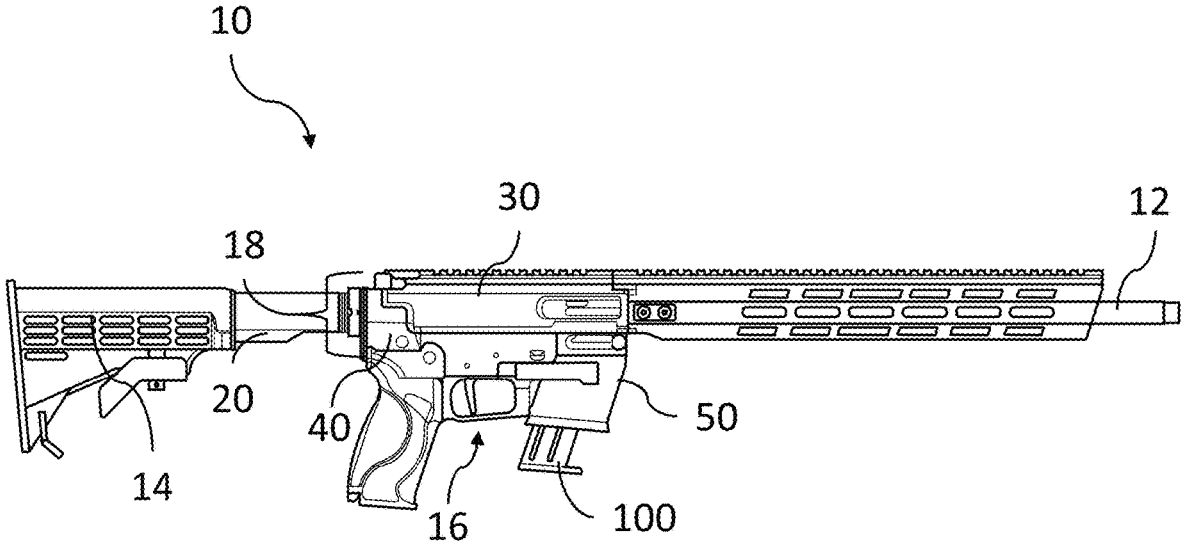
FIG. 1 shows a side view of an example firearm as disclosed herein.

FIG. 1 shows a firearm 10, in this example a semi-automatic rifle. Although depicted in the drawings as a semi-automatic rifle, it is contemplated that other firearm designs and configurations can be compatible with the current disclosure. The firearm 10 comprises a barrel 12, a stock 14, and a firing mechanism 16 configured to connect to an upper receiver and lower receiver assembly 18. In this example, the stock 14 is configured to connect to the upper receiver and lower receiver assembly 18 via a receiver extension tube 20. The upper receiver and lower receiver assembly 18 includes an upper receiver 30 and a lower receiver 40. The firearm 10 comprises a magazine well assembly 50 removably coupled to the upper receiver and lower receiver assembly 18. The magazine well assembly 50 connects a magazine 100 to the firearm 10.

Figure 2:
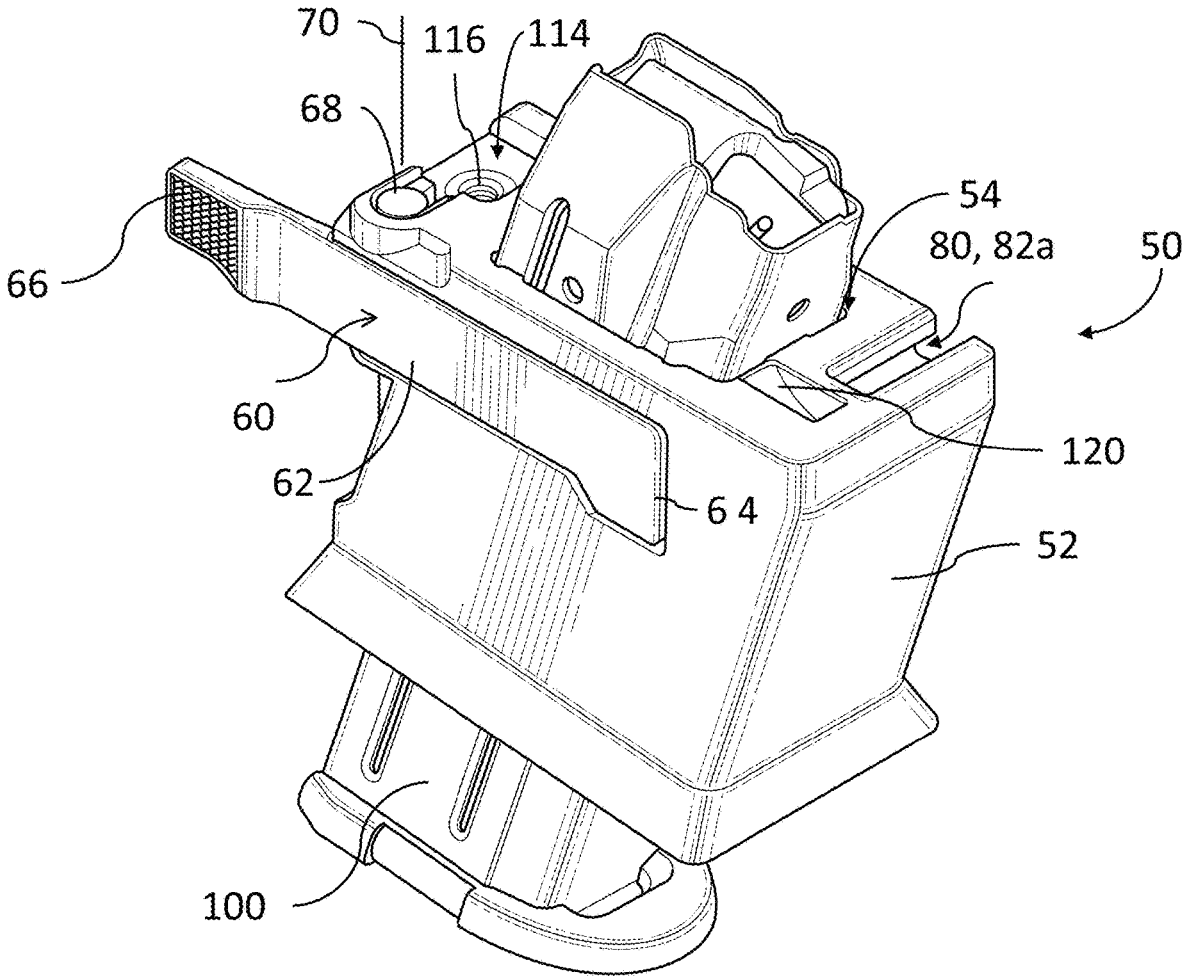
FIG. 2 shows a perspective view of an example magazine well assembly and magazine.
Figure 3:
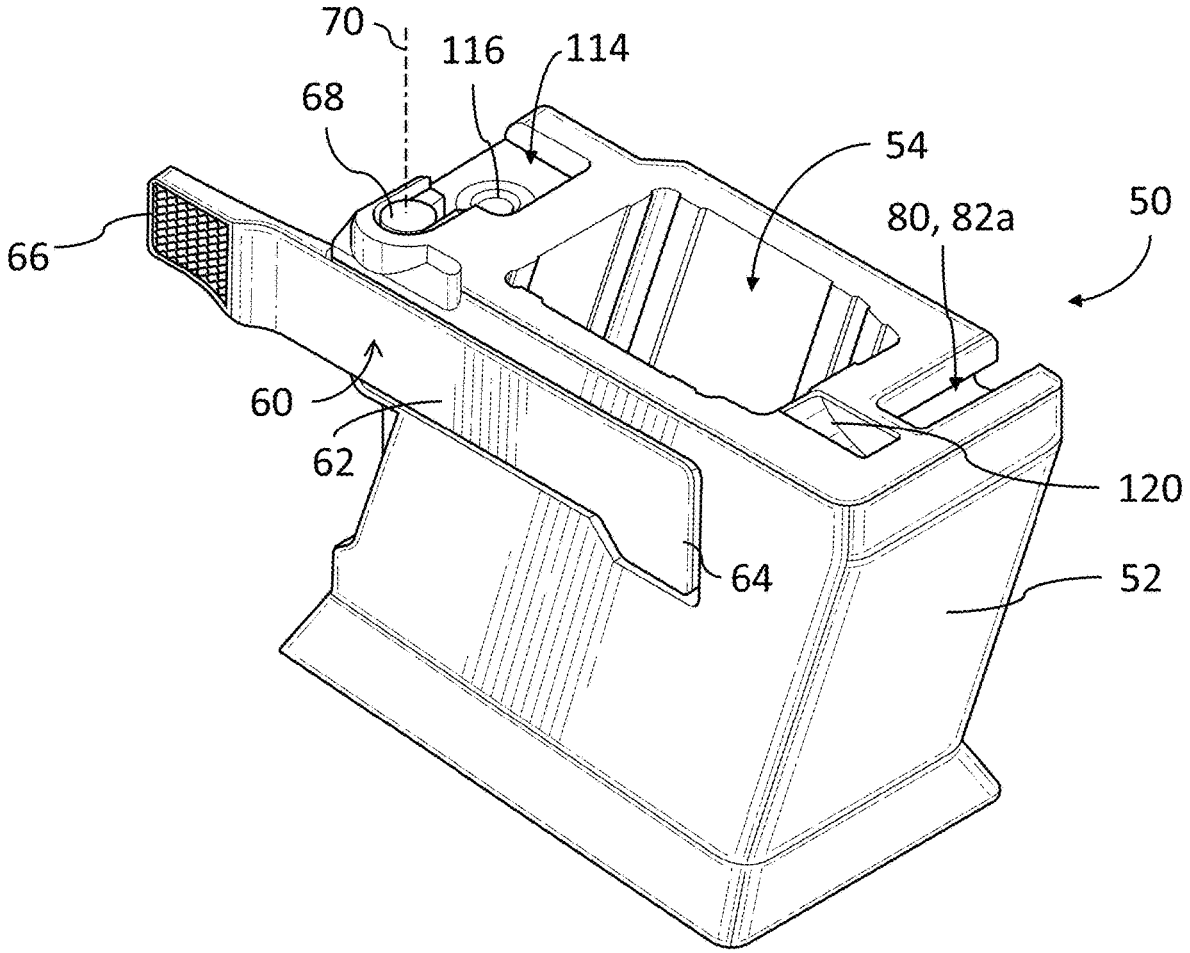
FIG. 3 shows an isolated perspective view of the example magazine well assembly of FIG. 2.
Figure 4:
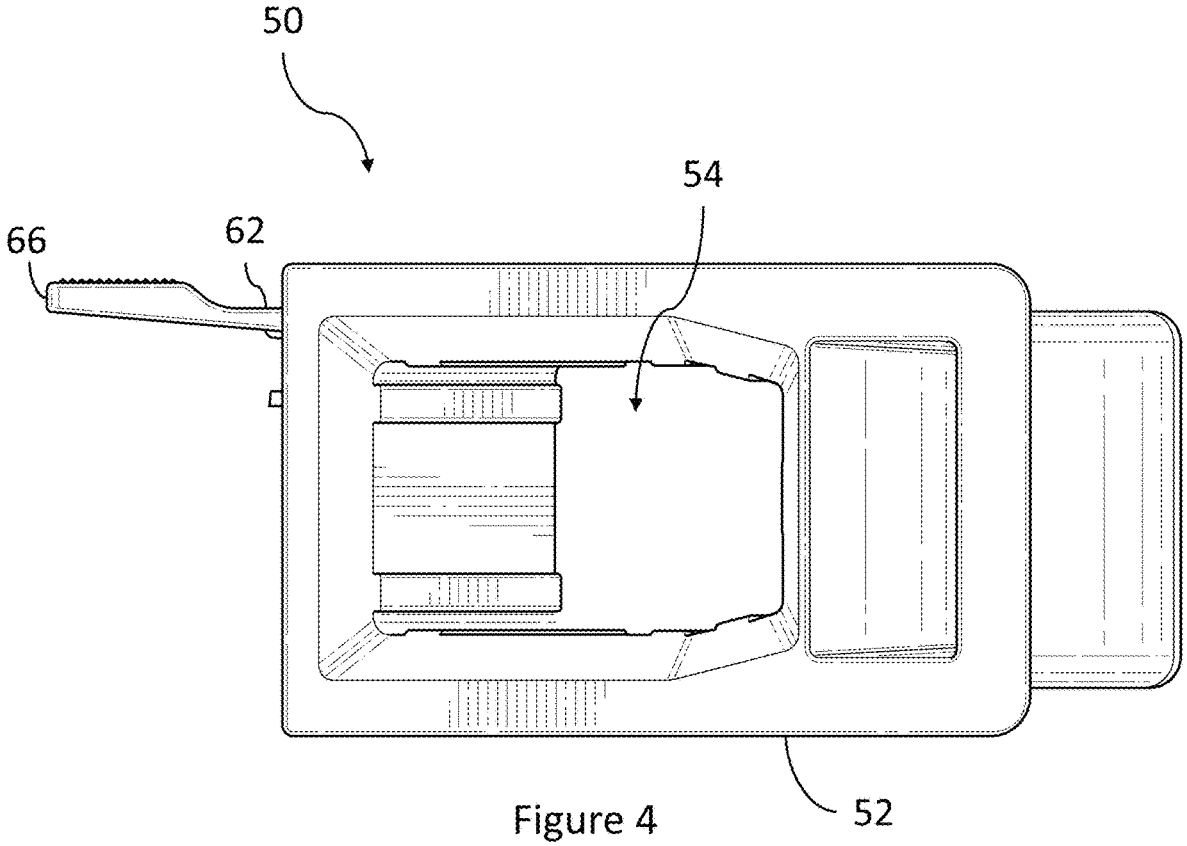
FIG. 4 shows a bottom view of the example magazine well assembly of FIG. 2.

As shown in FIG. 2, the magazine well assembly 50 is configured to receive and hold the magazine 100. As shown in FIGS. 2-6, the magazine well assembly 50 comprises a housing 52. In one aspect, the housing 52 may comprise a polymer material. The housing 52 defines a magazine receiving space 54 adapted to receive the magazine 100. The magazine receiving space 54 may be adapted to receive a predetermined magazine type. For example, the magazine receiving space 54 may be adapted to receive 20, 30 or 40 round box magazines. Exemplary magazine types that are suitable for use with the disclosed magazine receiving space 54 include, without limitation, SMITH & WESSON M&P style magazines, GLOCK 17 style magazines, and SIG SAUER P320 style magazines.

Figure 5:
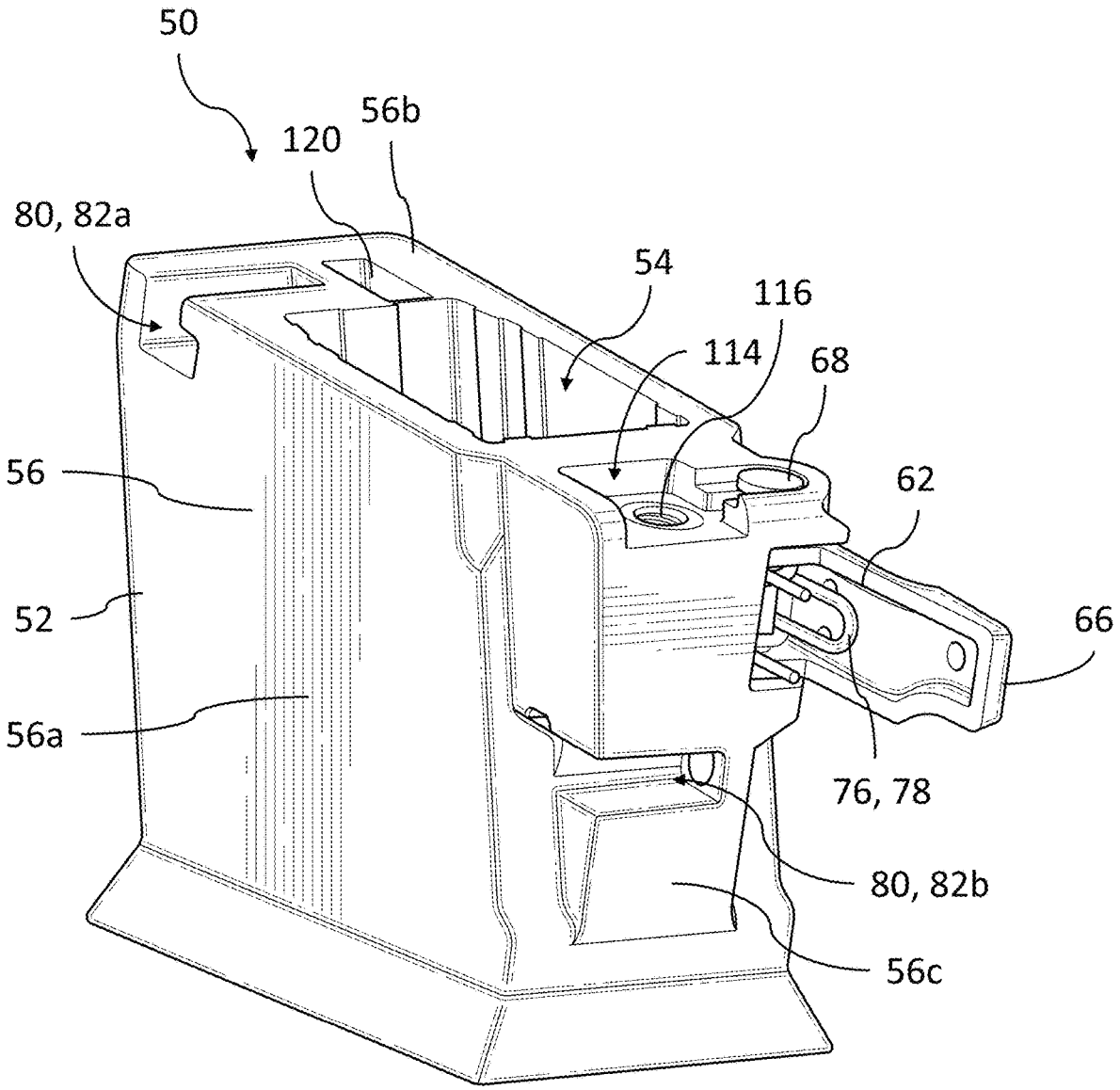
FIG. 5 shows a perspective view of the example magazine well assembly of FIG. 2.

The magazine well assembly 50 may comprise a latch 60 configured to lock and release the magazine 100 to and from the magazine receiving space 54. The latch 60 configuration shown in the figures and described herein is an exemplary latch. It is contemplated that other latch designs and configurations can be compatible with the current disclosure, including for example, cam latches, compression latches, other spring-loaded latches, and sliding latches. The latch 60 may be movable between a first position engaging the magazine 100 to fix the magazine 100 within the magazine receiving space 54 and a second position not engaging the magazine 100 thereby permitting removal of the magazine 100 from the magazine receiving space 54. The latch 60 may comprise a lever 62 having a first end 64 and a second end 66. The latch 60 may be pivotally coupled to the housing 52 between the first end 64 and the second end 66 of the lever 62. The latch 60 may be pivotally coupled to the housing 52 via a pin 68. In this example, the lever 62 is pivotably coupled to the housing 52 via the pin 68. The pin 68 may be configured to rotate about a first axis 70. The lever 62 may be configured to pivot about the first axis 70. The lever 62 may be configured to pivot about the first axis 70 between the first position, in which the magazine 100 is locked in the magazine receiving space 54, and the second position, in which the magazine 100 is released. As shown in FIG. 5, the latch 60 may comprise a biasing element 76, in this example a spring 78, acting between the housing 52 and the lever 62. The biasing element 76, in this example the spring 78, may be pre-loaded to bias the second end 66 of the lever 62 away from the housing 52 to pivot the latch 60 to the first position. A force acting on the second end 66 may compress the biasing element 76, in this example the spring 78, to pivot the latch 60 to the second position.

Figure 6:
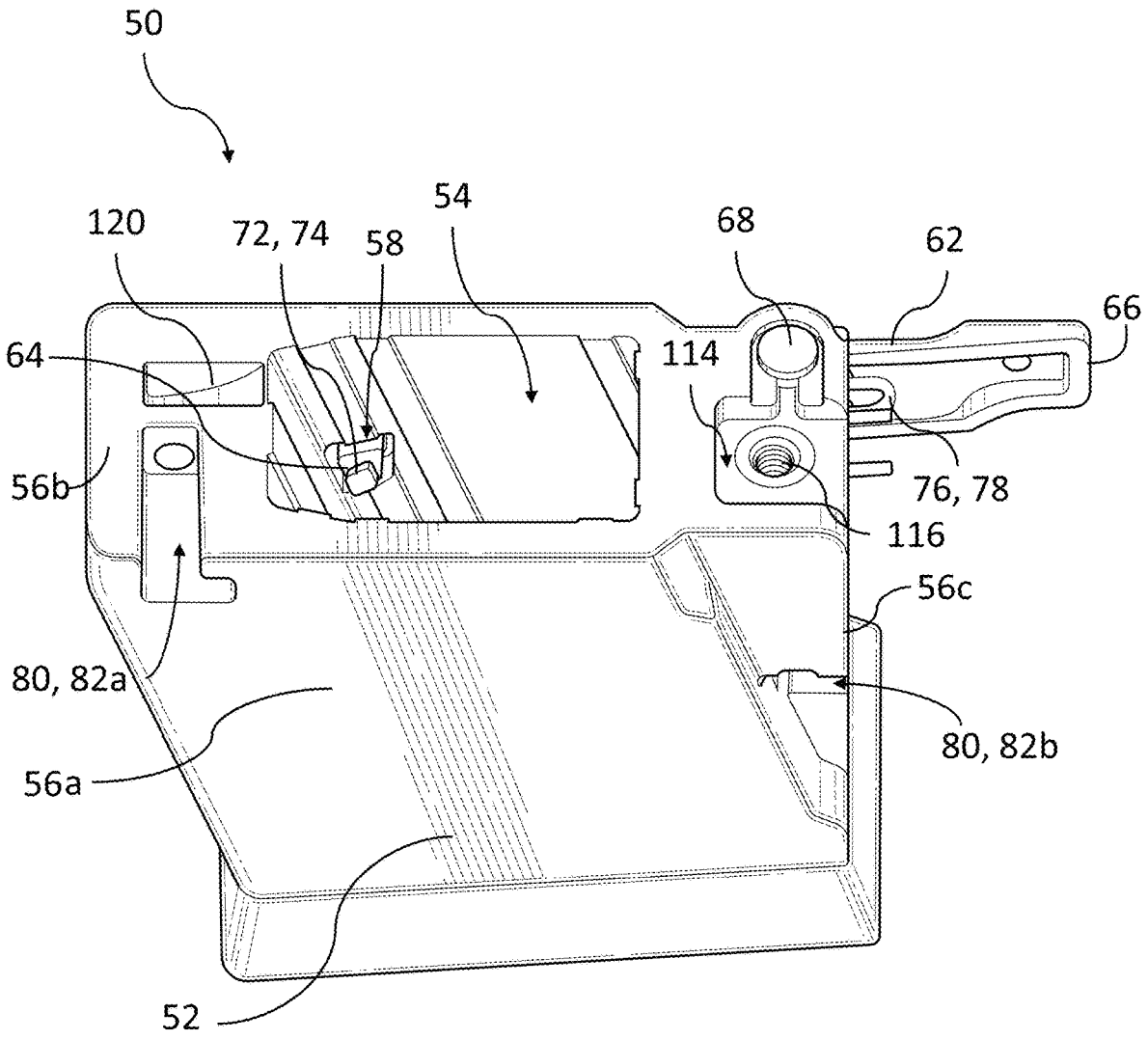
FIG. 6 shows a top perspective view of the example magazine well assembly of FIG. 2.
Figure 8:
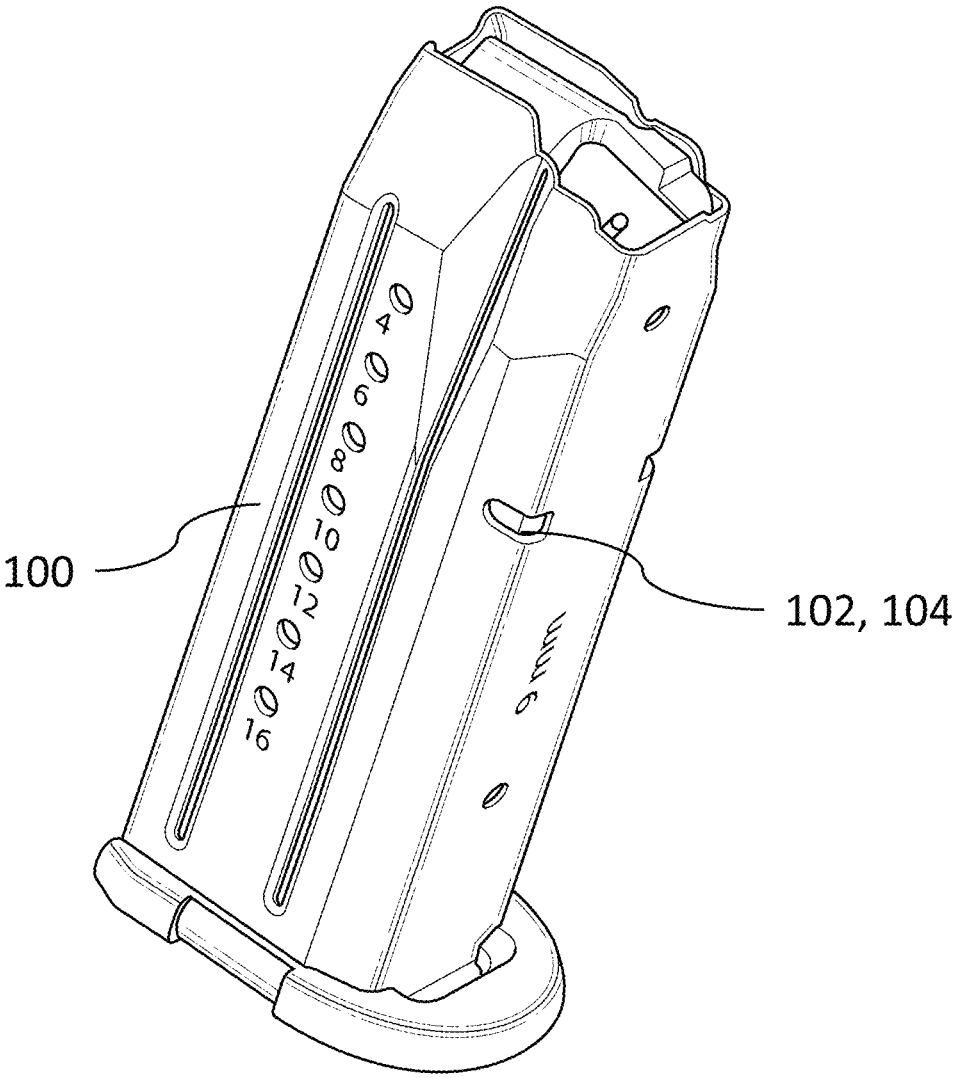
FIG. 8 shows an isolated perspective view of the example magazine of FIG. 2.

The housing 52 may have an exterior surface 56. As shown in FIG. 6, the housing 52 may define an opening 58 extending from the exterior surface 56 to the magazine receiving space 54. The latch 60 may comprise a first engagement surface 72 proximate to the first end 64 of the lever 62. The first engagement surface 72 may be configured to engage the magazine 100 to lock the magazine 100 in the magazine receiving space 54 when the latch 60 is in the first position. The first engagement surface 72 may comprise a projection 74 configured to extend through the opening 58 in the housing 52 and into the magazine receiving space 54 to lock with a second engagement surface 102 on the magazine 100 (shown in FIG. 8) when the latch 60 is in the first position. As shown in FIG. 8, the second engagement surface 102 on the magazine 100 may define a recess 104 configured to receive the projection 74 of the latch 60 when the latch 60 is in the first position. When the latch 60 is pivoted to the second position, the projection 74 may disengage the recess 104 and the magazine 100 may be released from the magazine well assembly 50.

The magazine well assembly 50 and the magazine 100 are assembled together by inserting the magazine 100 into the magazine receiving space 54 defined by the housing 52 of the magazine well assembly 50. The magazine well assembly 50 and the magazine 100 are further assembled together by locking the magazine 100 to the housing 52 with the latch 60. The magazine well assembly 50 and the magazine 100 may be separated from one another by pushing the second end 66 of the lever 62 of the latch 60 to compress the biasing element 76, in this example the spring 78, and pivoting the latch 60 to the second position to disengage the first engagement surface 72 from the second engagement surface 102 on the magazine 100, in this example the projection 74 and the recess 104. The magazine 100 may then be removed from the magazine receiving space 54.

Figure 7:
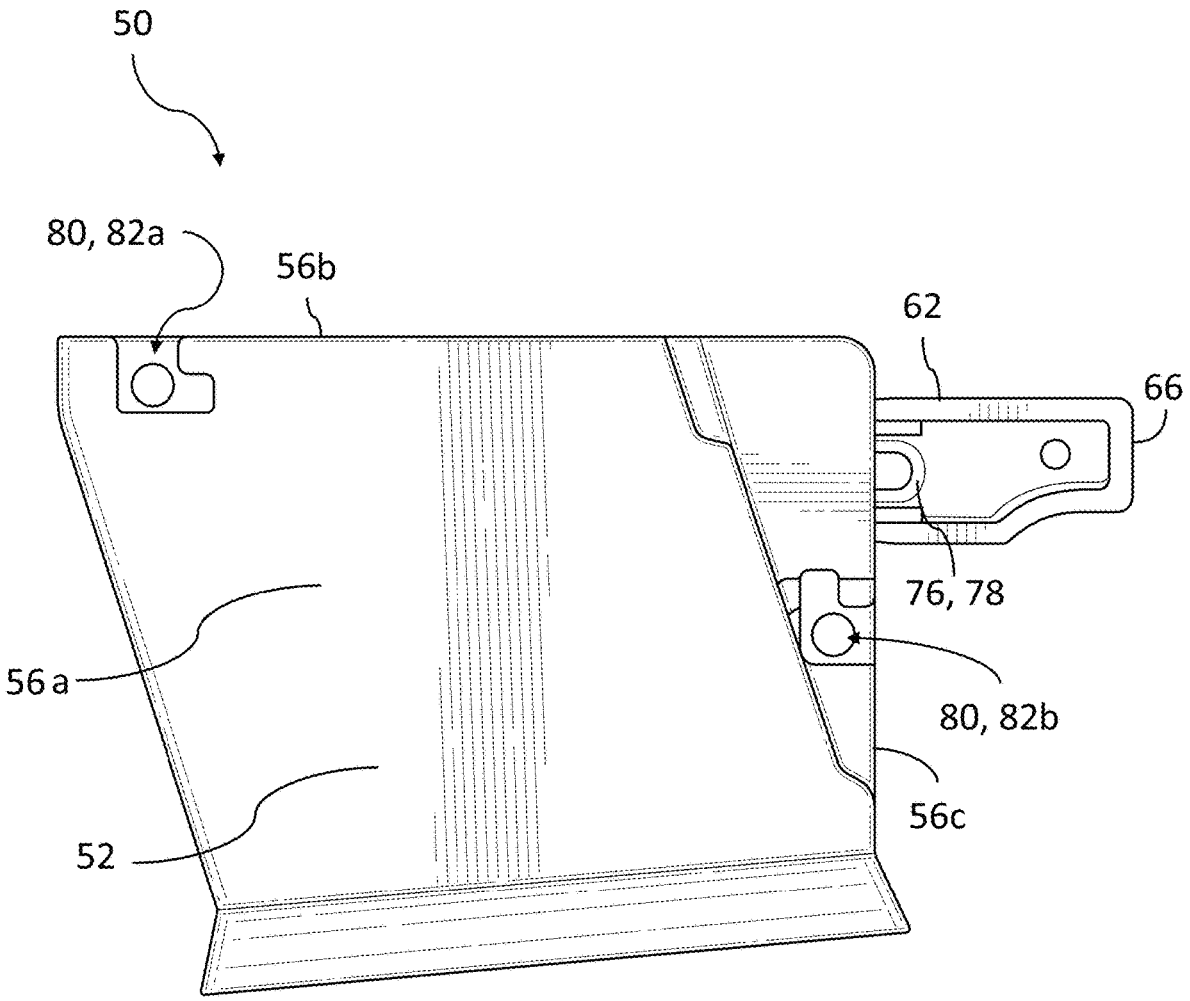
FIG. 7 shows a side view of the example magazine well assembly of FIG. 2.
Figure 9:
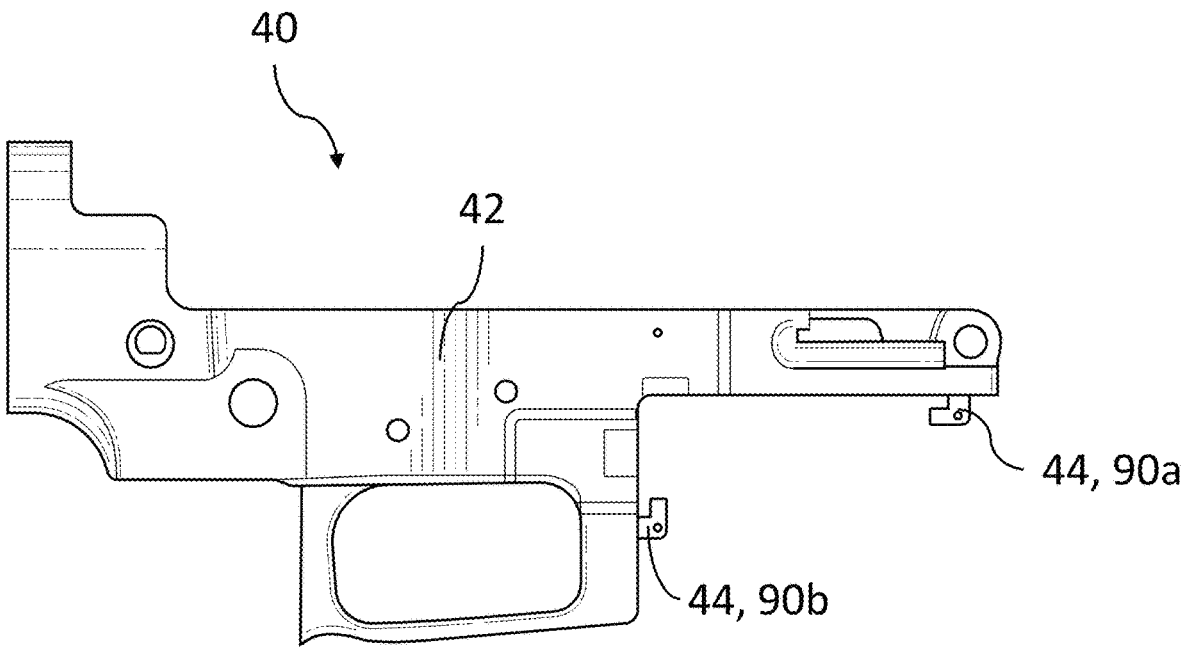
FIG. 9 shows a side view of an example lower receiver.
Figure 10:
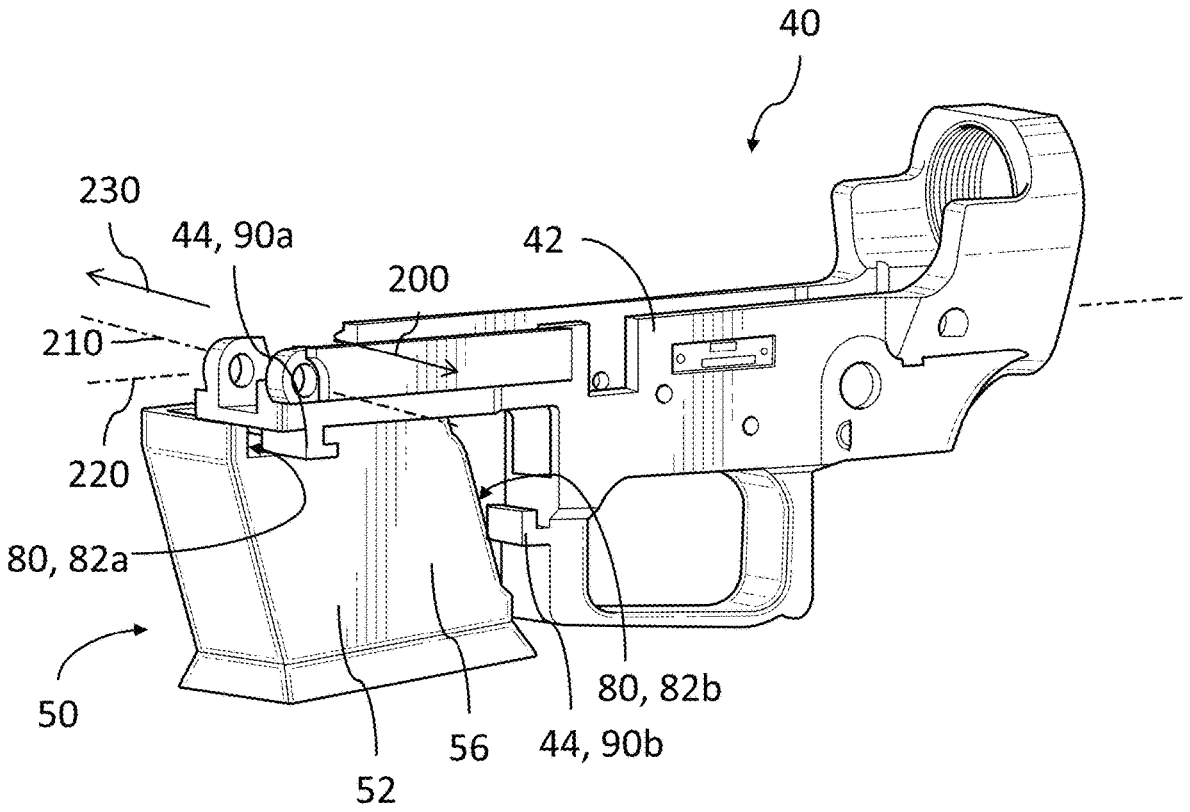
FIG. 10 shows a front, right-side perspective view of an example magazine well assembly with the example lower receiver of FIG. 9.
Figure 11:
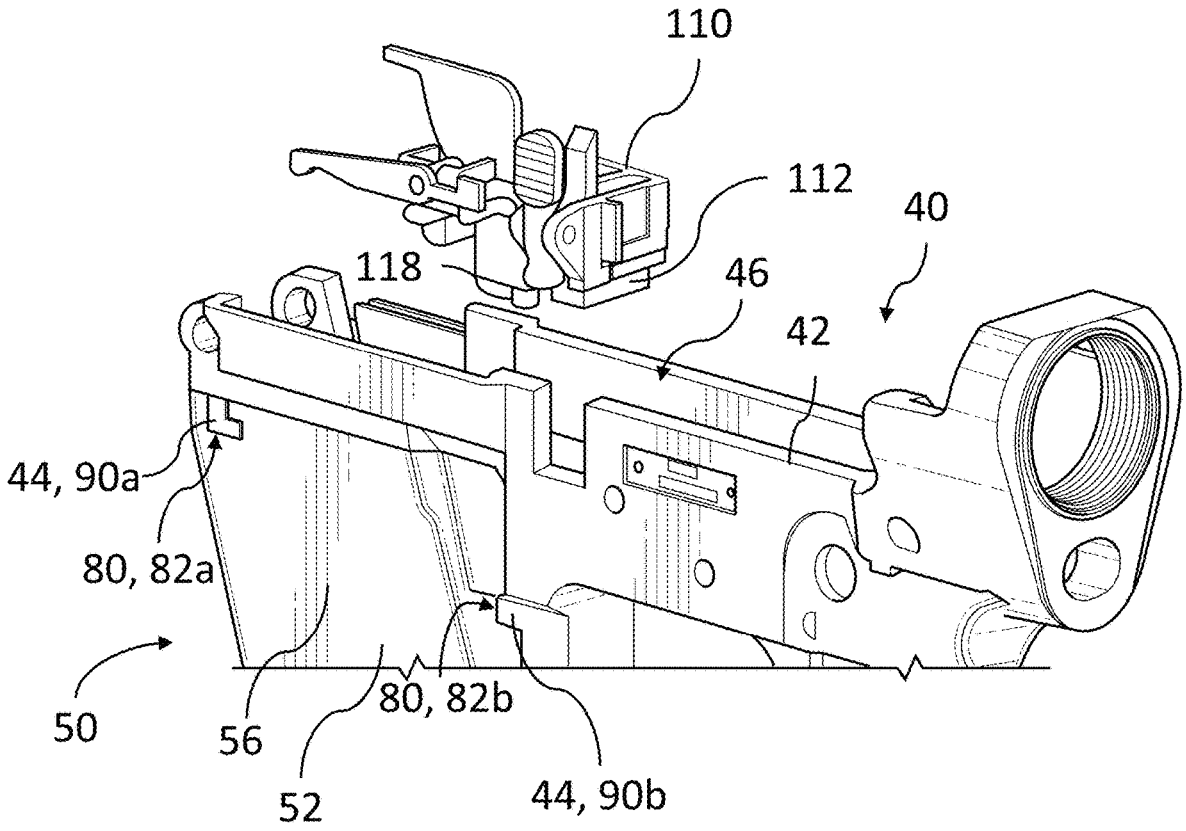
FIG. 11 shows a back, left-side perspective view of the example magazine well assembly assembled with the example lower receiver of FIG. 10 and a bolt catch assembly.
Figure 12:
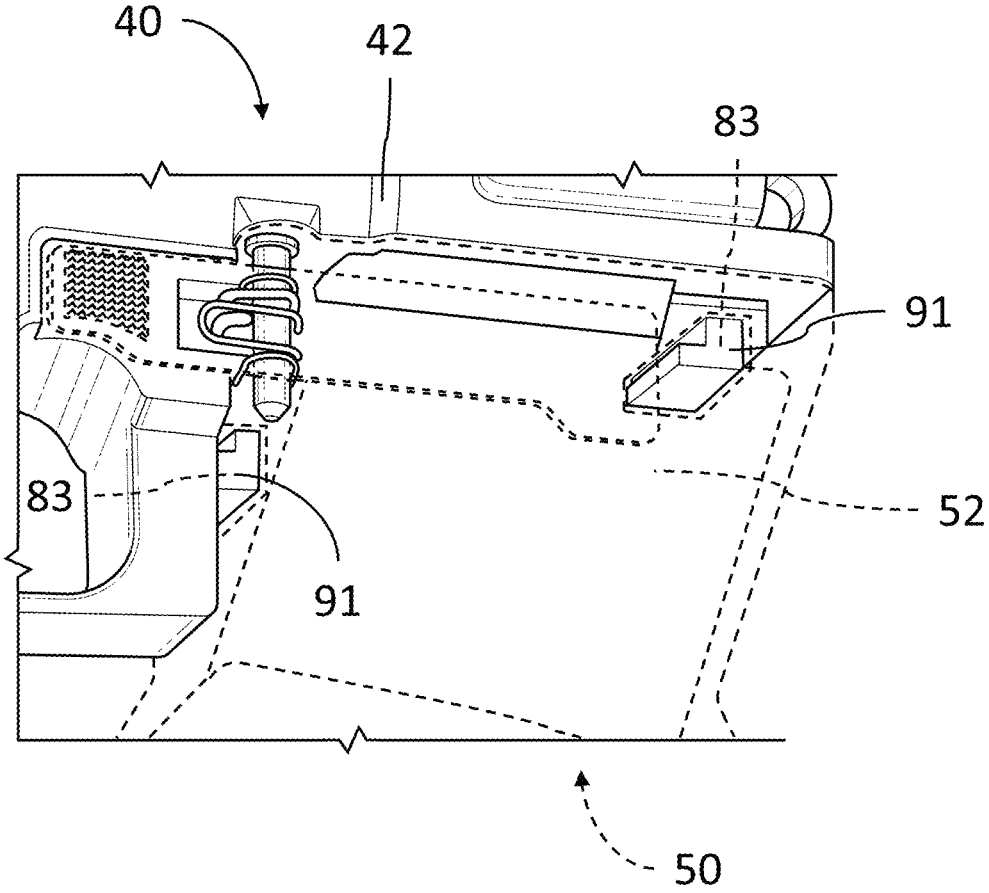
FIG. 12 shows a side view of an example magazine well assembly assembled with an example lower receiver with the magazine well assembly and lever shown transparently and underlying features shown in solid line.

As shown in FIGS. 5-7, the magazine well assembly 50 comprises at least one connector 80 configured to removably couple the housing 52 to the lower receiver 40 of the firearm 10. As shown in FIGS. 9-11, the lower receiver 40 of the firearm 10 comprises a frame 42. The frame 42 does not comprise a magazine well. The lower receiver 40 is in an assembled state (and ready to receive a magazine) when coupled to a magazine well assembly 50 (shown in at least FIGS. 12 to 17A). The lower receiver 40 is in an unassembled state (and not capable of receiving a magazine) when the lower receiver 40 is not coupled to a magazine well assembly (shown in FIG. 9). The frame 42 comprises a slot 43 (shown in FIG. 16) adapted to overlie the magazine receiving space 54 of the magazine well assembly 50 when the magazine well assembly 50 is coupled to the lower receiver 40 and configured to receiver the magazine 100. The frame 42 comprises at least one connector 44. As shown in FIGS. 10-11, each connector 44 is configured to complementarily engage a respective connector 80 to removably couple the housing 52 of the magazine well assembly 50 to the frame 42 of the lower receiver 40. The connector 80 may be configured to receive the connector 44 or vice versa. The lower receiver 40 may be configured to connect to the connector 80 of the magazine well assembly by sliding a first connector 44 of the at least one connector 44 of the lower receiver 40 in a direction 200 transversely or substantially transversely (e.g., within 10 degrees of perpendicular) to a longitudinal axis 220 of the lower receiver 40 to engage the magazine well assembly. In this example, each connector 80 is a female dovetail 82*a*, 82*b* defined within the exterior surface 56 of the housing 52 and each connector 44 is a male dovetail projection 90*a*, 90*b* from the frame 42. Each female dovetail 82*a*, 82*b* is configured to receive a respective male dovetail projection 90*a*, 90*b*. In this example, a first female dovetail 82*a* is defined in the housing 52 at an intersection of an upper exterior surface 56*b* and a side exterior surface 56*a* (FIG. 5). A second female dovetail 82*b* is defined in the housing 52 at an intersection of a rear exterior surface 56*c* and the side exterior surface 56*a* of the housing 52 (FIG. 5). As shown in FIGS. 10 and 12, the magazine well assembly 50 may be assembled to the lower receiver 40 by inserting and sliding the male dovetail projection 90*a*, 90*b* into the corresponding female dovetail 82*a*, 82*b* in a first direction 200 along a second axis 210 transverse to a longitudinal axis 220 of the lower receiver 40 until a stop surface 91 of each male dovetail projection 90*a*, 90*b* abuts a stop surface 83 of the respective female dovetail 82*a*, 82*b*. The magazine well assembly 50 may be disassembled from the lower receiver 40 by moving the magazine well assembly 50 along a second direction 230 opposite to the first direction 200 until the female dovetails 82*a*, 82*b* disengage from the male dovetail projections 90*a*, 90*b*. In the exemplary, non-limiting embodiments shown in FIGS. 10-11, the male dovetail projection 90*a* can project in a downward direction from a bottom surface of the frame, into a void space where the housing 52 of the magazine well assembly 50 is received. In these optional embodiments, the male dovetail projection 90*b* can project in a forward direction from a front-facing surface of the frame, into the void space where the housing 52 of the magazine well assembly 50 is received. Further, it is contemplated that the at least one connector 80 of the magazine assembly 50 may be a male dovetail and the at least one connector 44 of the lower receiver 40 is a corresponding female dovetail. Optionally, one or more of the male dovetail projections 90*a*, 90*b* can have a cross-sectional profile that is generally L-shaped, and one or more of the female dovetails 82*a*, 82*b* can have a corresponding L-shaped cross-sectional profile. In use, it is contemplated that dovetail joints having a generally L-shaped cross-sectional profile can help restrict downward and/or longitudinal movement of the magazine well assembly 50. As used herein, the term "dovetail" does not require a particular shape; rather, it is understood that the term "dovetail" includes interlocking structures that fit tightly to form a joint. Optionally, the "dovetail" connections disclosed herein can include conventional tenon and mortise structures, however, it is contemplated that any suitable interlocking structure, including the generally L-shaped structures depicted throughout the Figures, can be employed.

Figure 13:
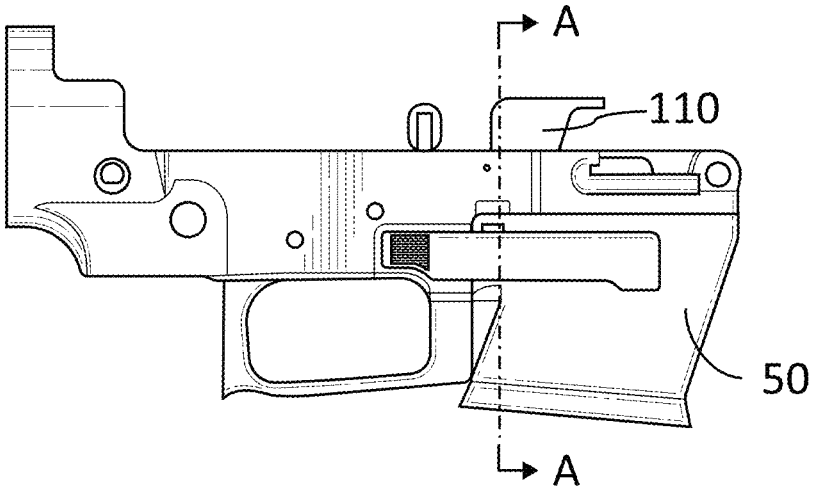
FIG. 13 shows a side view of an example magazine well assembly assembled with an example lower receiver, along with an example bolt catch assembly.
Figure 13A:
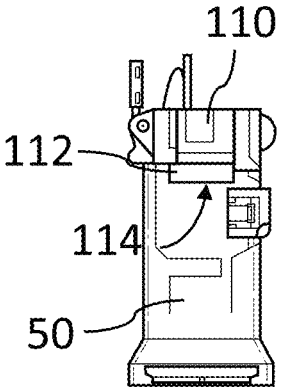
FIG. 13A shows a section view along line A-A in FIG. 13.
Figure 14:
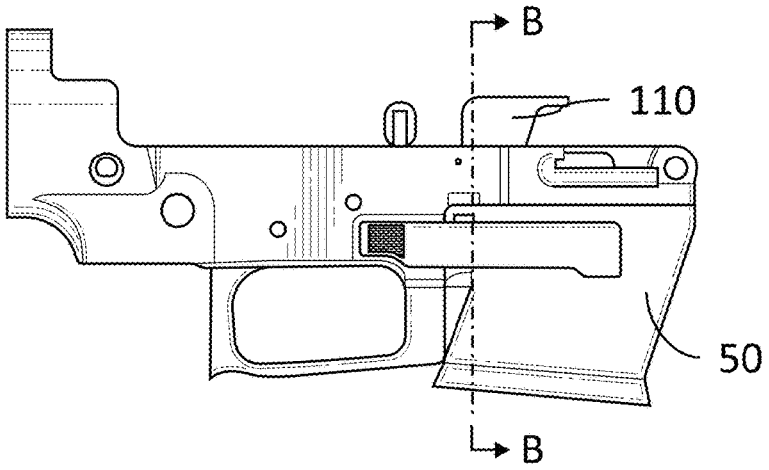
FIG. 14 shows a side view of an example magazine well assembly assembled with an example lower receiver, along with an example bolt catch assembly.
Figure 14A:
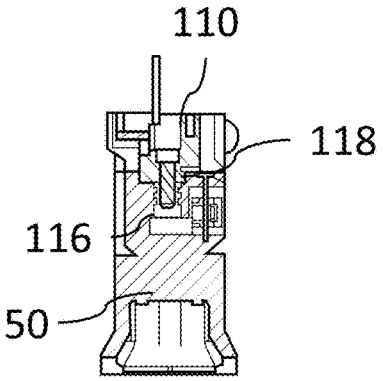
FIG. 14A shows a section view along line B-B in FIG. 14.
Figure 15:
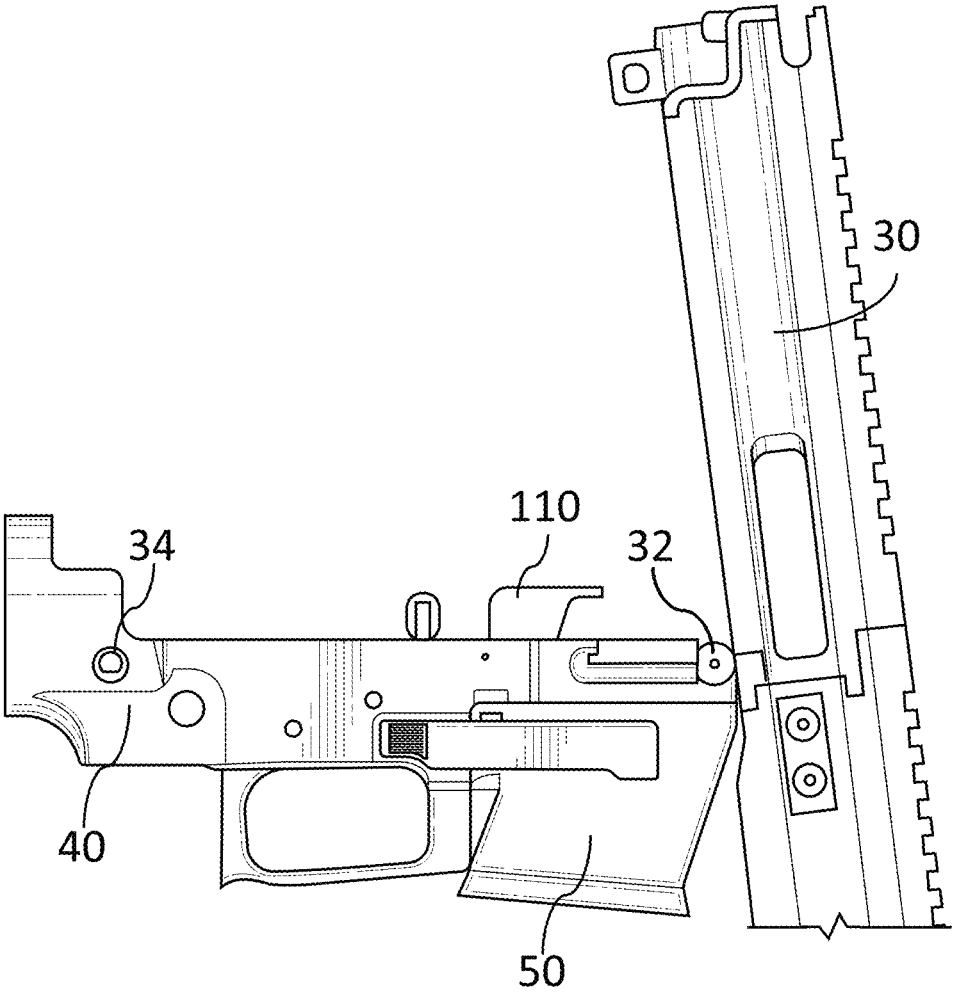
FIG. 15 shows a side view of an example magazine well assembly assembled with an example lower receiver and an example bolt catch assembly, along with an example upper receiver.
Figure 16:
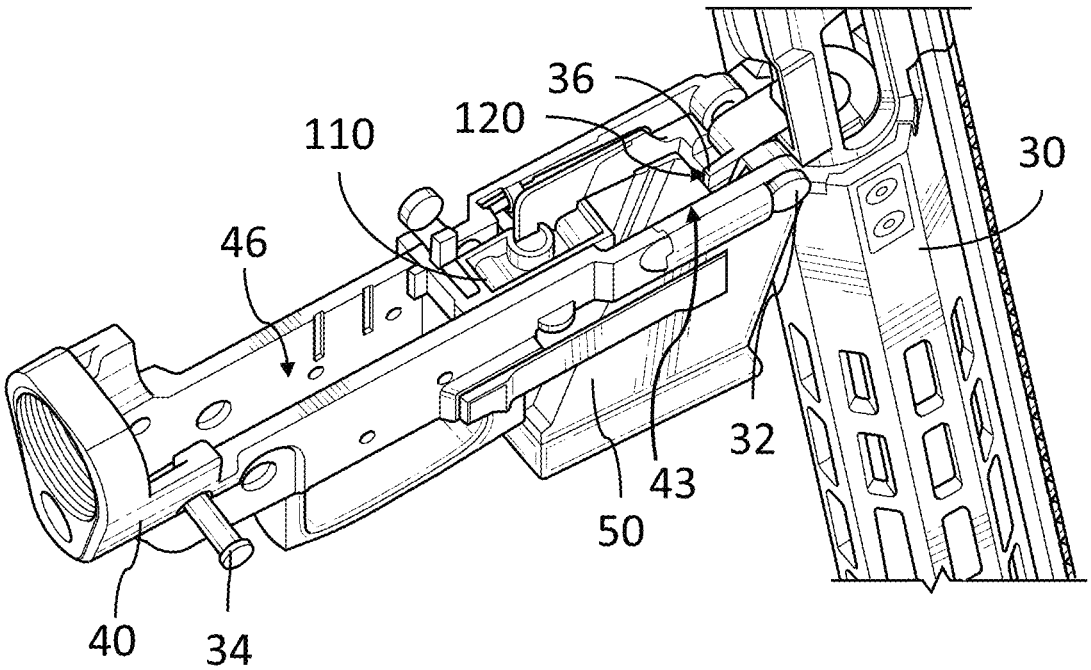
FIG. 16 shows a top perspective view of the example magazine well assembly assembled with the example lower receiver, along with the example bolt catch assembly and the example upper receiver shown in FIG. 15.

As shown in FIGS. 11 and 16, the frame 42 of the lower receiver 40 may define an opening 46 adapted to receive a bolt catch assembly 110. As shown in FIGS. 13 and 13A, when the magazine well assembly 50 is assembled to the lower receiver 40, a recess 114 defined in the upper exterior surface 56*b* is configured to receive at least a portion of a base 112 of the bolt catch assembly 110. The mechanical fitment of the recess 114 and base 112 connection prevents the magazine well assembly 50 from moving in the direction of disassembly. As shown in FIGS. 14 and 14A, the magazine well assembly 50 may comprise an insert 116 in the upper exterior surface 56*b* of the housing 52. The insert 116 may be configured to receive a fastener 118 associated with the bolt catch assembly to couple the bolt catch assembly 110 to the housing 52 and restrict movement of the magazine well assembly 50 relative to the lower receiver 40. In this example, the fastener 118 is a screw and the insert 116 comprises corresponding threads.

Figure 17A:
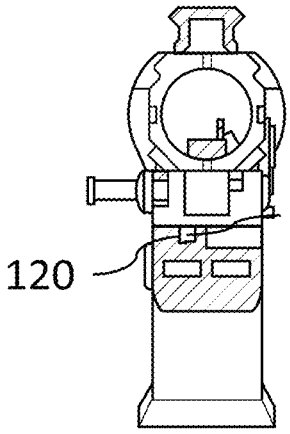
FIG. 17A shows a section view along line C-C in FIG. 17.
Figure 17:
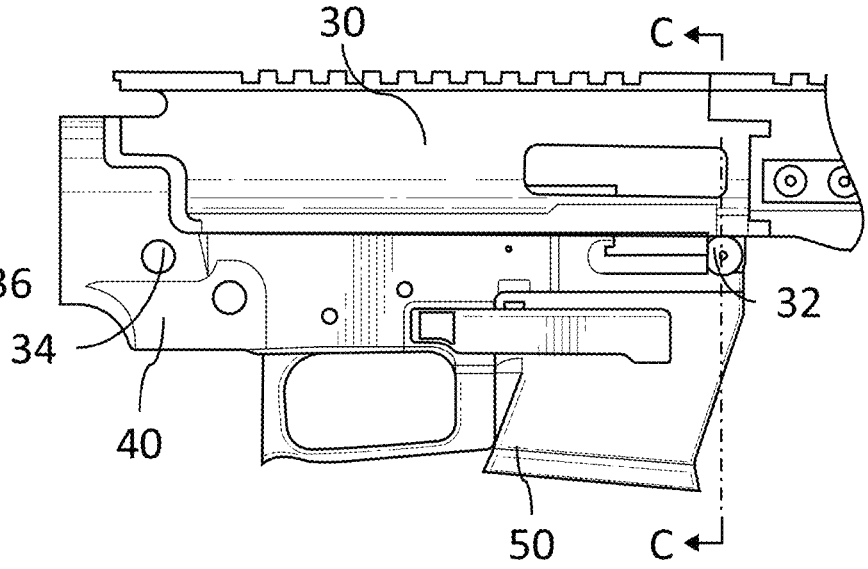
FIG. 17 shows a side view of an example magazine well assembly assembled with an example lower receiver and upper receiver.

As shown in FIGS. 15-17A, the upper receiver 30 is configured to couple with the lower receiver 40. The upper receiver 30 may be coupled to the lower receiver 40 via a first pin 32 and a second pin 34. As shown in FIGS. 16 and 17A, the upper receiver 30 may comprise a locking arm 36. The upper exterior surface 56*b* of the housing 52 may define a recess 120 configured to receive the locking arm 36. The mechanical fitment of the recess 120 and locking arm 36 connection prevents the magazine well assembly 50 from moving in the direction of disassembly.

A user may interchange magazine well assemblies and respective magazine types on a lower receiver of a firearm. A method of interchanging magazine well assemblies may comprise attaching a first magazine well assembly to a lower receiver of a firearm by joining each connector of at least one connector of a housing of the first magazine well assembly to a respective connector of at least one connector of a frame of the lower receiver of a firearm to connect a first type of magazine within a magazine receiving space defined by the housing of the first magazine well assembly to the lower receiver. The method may comprise removing the first magazine well assembly from the lower receiver by disengaging each connector of the at least one connector and the respective connector of the at least one connector.

The method may comprise attaching a second magazine well assembly to the lower receiver of the firearm by joining each connector of at least one connector of a housing of a second magazine well assembly to the respective connector of the at least one connector of the frame of the lower receiver of the firearm to connect a second type of magazine within a magazine receiving space defined by the housing of the second magazine well assembly to the lower receiver. Each connector may be a male dovetail, and each connector and connector may be female dovetails configured to receive the male dovetail.

The first magazine well assembly may be attached to the lower receiver of the firearm by aligning the female dovetails of the first magazine well assembly and the male dovetails of the lower receiver and moving the first magazine well assembly in a first direction along a second axis transverse to a longitudinal axis of the lower receiver until the male dovetails of the lower receiver are fully inserted in the female dovetails of the first magazine well assembly.

The first magazine well assembly may be removed by moving the first magazine well assembly in a second direction opposite to the first direction until the female dovetails of the first magazine assembly are disengaged from the male dovetails of the lower receiver.

The second magazine well assembly may be attached to the lower receiver of the firearm by aligning the female dovetails of the second magazine well assembly and the male dovetails of the lower receiver and moving the second magazine well assembly in the first direction until the male dovetails of the lower receiver are fully inserted in the female dovetails of the second magazine well assembly.

It is expected that the example magazine well assembly 50 and corresponding methods according to the disclosure will allow a user to connect a magazine 100 to a firearm 10. Because the magazine well assembly 50 is removably coupled to the lower receiver 40 of the firearm 10, a magazine well assembly 50 may be selected or interchanged with another magazine well assembly 50 based on a desired magazine type thereby allowing different magazine types to be used with a firearm. Further, the example magazine well assembly 50 according to the disclosure includes components which provide definitive positional control of the magazine well assembly 50 with the upper receiver 30 and lower receiver 40 when assembled with the firearm 10.

All of the embodiments of the claimed invention described herein are provided expressly by way of example only. Innumerable variations and modifications may be made to the example embodiments described herein without departing from the concept of this disclosure. Additionally, the scope of this disclosure is intended to encompass any and all modifications and combinations of all elements, features, and aspects described in the specification and claims, and shown in the drawings. Any and all such modifications and combinations are intended to be within the scope of this disclosure.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A magazine well assembly for connecting a magazine to a firearm, the assembly comprising:

a housing defining a magazine receiving space adapted to receive the magazine; and at least one first connector configured to removably couple the housing to a lower receiver of the firearm.

Aspect 2: The assembly according to aspect 1, wherein the magazine receiving space is adapted to receive a predetermined magazine type.

Aspect 3: The assembly according to aspect 1 further comprising a latch, the latch movable between a first position engaging the magazine to fix the magazine within the magazine receiving space, and a second position not engaging the magazine thereby permitting removal of the magazine from the magazine receiving space.

Aspect 4: The assembly according to aspect 3, wherein the latch comprises a lever having a first end and a second end, the lever pivotally coupled to the housing between the first end and the second end.

Aspect 5: The assembly according to aspect 4, wherein the latch is pivotally coupled to the housing via a pin, the pin configured to rotate about a first axis, the latch configured to pivot about the first axis.

Aspect 6: The assembly according to aspect 4, wherein the housing has an exterior surface and defines an opening extending from the exterior surface to the magazine receiving space, wherein the latch comprises a first engagement surface proximate to the first end, the first engagement surface comprising a projection configured to extend through the opening in the housing and into the magazine receiving space to lock with a second engagement surface on the magazine when the latch is in the first position.

Aspect 7: The assembly according to aspect 4, wherein the latch further comprises a spring acting between the housing and the lever, the spring pre-loaded to bias the second end of the lever away from the housing to pivot the latch to the first position, wherein a force acting on the second end compresses the spring to pivot the latch to the second position.

Aspect 8: The assembly according to aspect 1, wherein the housing comprises polymer material.

Aspect 9: The assembly according to aspect 1, wherein each first connector of the at least one first connector is a female dovetail defined within an exterior surface of the housing, the female dovetail configured to complementarily receive and engage a respective male dovetail projecting from the lower receiver.

Aspect 10: The assembly according to aspect 9, wherein a first female dovetail is defined in the housing at an intersection of an upper exterior surface and a side exterior surface of the housing and a second female dovetail is defined in the housing at an intersection of a rear exterior surface and the side exterior surface of the housing.

Aspect 11: The assembly according to aspect 1 further comprising an insert in an upper exterior surface of the housing, the insert configured to receive a fastener to couple a bolt catch assembly to the housing and restrict movement of the magazine well assembly relative to the lower receiver.

Aspect 12: The assembly according to aspect 11, wherein the insert is a threaded insert configured to receive a threaded fastener associated with a bolt catch assembly.

Aspect 13: The assembly according to aspect 1, wherein the housing comprises an upper exterior surface defining a recess configured to receive a locking arm of an upper receiver.

Aspect 14: In combination, a magazine well assembly and a lower receiver for a firearm, the magazine well assembly comprising:

a housing defining a magazine receiving space adapted to receive a magazine, the housing comprising at least one first connector;

the lower receiver comprising:

a frame comprising at least one second connector, each second connector of the at least one second connector configured to complementarily engage a respective first connector of the at least one first connector to removably couple the housing to the frame.

Aspect 15: The combination according to aspect 14, wherein the magazine receiving space is adapted to receive a predetermined magazine type.

Aspect 16: The combination according to aspect 14, wherein the magazine well assembly further comprises a latch, the latch movable between a first position engaging the magazine to fix the magazine within the magazine receiving space, and a second position not engaging the magazine thereby permitting removal of the magazine from the magazine receiving space.

Aspect 17: The combination according to aspect 16, wherein the latch comprises a lever having a first end and a second end, the lever pivotally coupled to the housing between the first end and the second end.

Aspect 18: The combination according to aspect 17, wherein the latch is pivotally coupled to the housing via a pin, the pin configured to rotate about a first axis, the latch configured to pivot about the first axis.

Aspect 19: The combination according to aspect 17, wherein the housing has an exterior surface and defines an opening extending from the exterior surface to the magazine receiving space, wherein the latch comprises a first engagement surface proximate to the first end, the first engagement surface comprising a projection configured to extend through the opening in the housing and into the magazine receiving space to lock with a second engagement surface on the magazine when the latch is in the first position.

Aspect 20: The combination according to aspect 17, wherein the latch further comprises a spring acting between the housing and the lever, the spring pre-loaded to bias the second end of the lever away from the housing to pivot the latch to the first position, wherein a force acting on the second end compresses the spring to pivot the latch to the second position.

Aspect 21: The combination according to aspect 14, wherein the housing comprises polymer material.

Aspect 22: The combination according to aspect 14, wherein each first connector of the at least first one connector is a female dovetail defined within an exterior surface of the housing, wherein each second connector of the at least one second connector is a male dovetail projection from the frame, and wherein each first connector of the at least one first connector is configured to complementarily receive and engage a respective second connector of the at least one second connector.

Aspect 23: The combination according to aspect 22, wherein a first female dovetail is defined in the housing at an intersection of an upper exterior surface and a side exterior surface of the housing and a second female dovetail is defined in the housing at an intersection of a rear exterior surface and the side exterior surface of the housing.

Aspect 24: The combination according to aspect 14, wherein the frame defines an opening adapted to receive a bolt catch assembly.

Aspect 25: The combination according to aspect 24, wherein the magazine well assembly further comprises an insert in an upper exterior surface of the housing, the insert configured to receive a fastener associated with the bolt catch assembly to couple the bolt catch assembly to the housing and restrict movement of the magazine well assembly relative to the lower receiver.

Aspect 26: The combination according to aspect 14, wherein the frame is configured to couple with an upper receiver.

Aspect 27: The combination according to aspect 26, wherein the upper receiver comprises a locking arm, and the housing comprises an upper exterior surface defining a recess configured to receive the locking arm.

Aspect 28: The combination according to aspect 14, wherein the frame further comprises a slot adapted to overlie the magazine receiving space, the slot configured to receive the magazine.

Aspect 29: A firearm comprising:

a magazine well assembly comprising a housing defining a magazine receiving space adapted to receive a magazine, the housing comprising at least one first connector;

a lower receiver comprising a frame comprising at least one second connector, each second connector of the at least one second connector configured to complementarily engage with a respective first connector of the at least one first connector to removably couple the housing to the frame; and an upper receiver configured to connect to the lower receiver and the magazine well assembly.

Aspect 30: The firearm according to aspect 29, wherein the magazine receiving space is adapted to receive a predetermined magazine type.

Aspect 31: The firearm according to aspect 29, wherein the magazine well assembly further comprises a latch, the latch movable between a first position engaging the magazine to fix the magazine within the magazine receiving space, and a second position not engaging the magazine thereby permitting removal of the magazine from the magazine receiving space.

Aspect 32: The firearm according to aspect 31, wherein the latch comprises a lever having a first end and a second end, the lever pivotally coupled to the housing between the first end and the second end.

Aspect 33: The firearm according to aspect 32, wherein the latch is pivotally coupled to the housing via a pin, the pin configured to rotate about a first axis, the latch configured to pivot about the first axis.

Aspect 34: The firearm according to aspect 32, wherein the housing has an exterior surface and defines an opening extending from the exterior surface to the magazine receiving space, wherein the latch comprises a first engagement surface proximate to the first end, the first engagement surface comprising a projection configured to extend through the opening in the housing and into the magazine receiving space to lock with a second engagement surface on the magazine when the latch is in the first position.

Aspect 35: The firearm according to aspect 32, wherein the latch further comprises a spring acting between the housing and the lever, the spring pre-loaded to bias the second end of the lever away from the housing to pivot the latch to the first position, wherein a force acting on the second end compresses the spring to pivot the latch to the second position.

Aspect 36: The firearm according to aspect 29, wherein the housing comprises polymer material.

Aspect 37: The firearm according to aspect 29, wherein each first connector of the at least first one connector is a female dovetail defined within an exterior surface of the housing, wherein each second connector of the at least one second connector is a male dovetail projection from the frame, and wherein each first connector of the at least one first connector is configured to complementarily receive and engage a respective second connector of the at least one second connector.

Aspect 38: The firearm according to aspect 37, wherein a first female dovetail is defined in the housing at an intersection of an upper exterior surface and a side exterior surface of the housing and a second female dovetail is defined in the housing at an intersection of a rear exterior surface and the side exterior surface of the housing.

Aspect 39: The firearm according to aspect 29 further comprising a bolt catch assembly, wherein the frame defines an opening adapted to receive the bolt catch assembly.

Aspect 40: The firearm according to aspect 39, wherein the magazine well assembly further comprises an insert in an upper exterior surface of the housing, the insert configured to receive a fastener associated with the bolt catch assembly to couple the bolt catch assembly to the housing and restrict movement of the magazine well assembly relative to the lower receiver.

Aspect 41: The firearm according to aspect 29, wherein the upper receiver comprises a locking arm, and the housing comprises an upper exterior surface defining a recess configured to receive the locking arm.

Aspect 42: The firearm according to aspect 29, wherein the frame further comprises a slot adapted to overlie the magazine receiving space, the slot configured to receive the magazine.

Aspect 43: A method of assembling and disassembling a magazine well assembly and a magazine, the method comprising:

inserting the magazine into a magazine receiving space defined by a housing of the magazine well assembly, the housing comprising at least one first connector configured to removably couple the housing to a lower receiver of a firearm; and locking the magazine to the housing with a latch, the latch comprising a spring and a lever having a first end and a second end, the lever pivotally attached to the housing between the first end and the second end, the spring acting between the housing and the lever and biasing the second end of the lever away from the housing to pivot the latch to a first position, wherein a first engagement surface proximate to the first end of the lever comprises a projection extending through an opening in the housing and engaging a second engagement surface on the magazine when the latch is in the first position.

Aspect 44: The method according to aspect 43 further comprising pushing the second end of the lever to compress the spring and pivot the latch to a second position, wherein the first end of the lever pivots away from the housing until the projection disengages the second engagement surface on the magazine when the latch is in the second position.

Aspect 45: The method according to aspect 44 further comprising removing the magazine from the magazine receiving space.

Aspect 46: A method comprising:

attaching a first magazine well assembly to a lower receiver of a firearm by joining each first connector of at least one first connector of a housing of the first magazine well assembly to a respective second connector of at least one second connector of a frame of the lower receiver of a firearm to connect a first type of magazine within a magazine receiving space defined by the housing of the first magazine well assembly to the lower receiver.

Aspect 47: The method according to aspect 46 further comprising removing the first magazine well assembly from the lower receiver by disengaging each first connector of the at least one first connector and the respective second connector of the at least one second connector.

Aspect 48: The method according to aspect 47 further comprising attaching a second magazine well assembly to the lower receiver of the firearm by joining each third connector of at least one third connector of a housing of a second magazine well assembly to the respective second connector of the at least one second connector of the frame of the lower receiver of the firearm to connect a second type of magazine within a magazine receiving space defined by the housing of the second magazine well assembly to the lower receiver.

Aspect 49: The method according to aspect 48, wherein each second connector is a male dovetail, and each first connector and third connector are female dovetails configured to receive the male dovetail.

Aspect 50: The method according to aspect 49, wherein the first magazine well assembly is attached to the lower receiver of the firearm by aligning the female dovetails of the first magazine well assembly and the male dovetails of the lower receiver and moving the first magazine well assembly in a first direction along a second axis transverse to a longitudinal axis of the lower receiver until the male dovetails of the lower receiver are fully inserted in the female dovetails of the first magazine well assembly.

Aspect 51: The method according to aspect 50, wherein the first magazine well assembly is removed by moving the first magazine well assembly in a second direction opposite to the first direction until the female dovetails of the first magazine assembly are disengaged from the male dovetails of the lower receiver.

Aspect 52: The method according to aspect 51, wherein the second magazine well assembly is attached to the lower receiver of the firearm by aligning the female dovetails of the second magazine well assembly and the male dovetails of the lower receiver and moving the second magazine well assembly in the first direction until the male dovetails of the lower receiver are fully inserted in the female dovetails of the second magazine well assembly.

Aspect 53: A lower receiver for a firearm, the lower receiver comprising:

a frame, wherein the frame does not comprise a magazine well; and at least one connector configured to connect to a magazine well assembly that is configured to receive a predetermined type of magazine, thereby permitting replacement of a first magazine well assembly that is configured to receive a first type of magazine with a second magazine well assembly that is configured to receive a second type of magazine.

Aspect 54: The lower receiver according to aspect 53, wherein the lower receiver is in an assembled state when coupled to the magazine assembly and in an unassembled state when the lower receiver is not coupled to the magazine assembly, wherein said lower receiver is incapable of receiving a magazine in said unassembled state.

Aspect 55: The lower receiver according to aspect 53, wherein the lower receiver is configured to connect to the magazine well assembly by sliding a first connector of the at least one connector in a direction transversely to a longitudinal axis of the lower receiver to engage the magazine well assembly.

Aspect 56: The lower receiver according to aspect 53, wherein each connector of the at least one connector is a male dovetail projecting from the frame, the male dovetail configured to complementarily insert into and engage a respective female dovetail defined within a housing of the magazine assembly.

Aspect 57: The lower receiver according to aspect 56, wherein the lower receiver is configured to connect to the magazine well by sliding the male dovetail in a direction transversely to a longitudinal axis of the lower receiver to engage the respective female dovetail.

Aspect 58: In combination, a lower receiver and a magazine well assembly for a firearm, the lower receiver comprising:

a frame, wherein the frame does not comprise a magazine well; and at least one first connector configured to connect to the magazine well assembly, wherein the magazine well assembly is configured to receive a predetermined type of magazine;

the magazine well assembly comprising:

a housing defining a magazine receiving space adapted to receive the predetermined type of magazine, the housing comprising at least one second connector configured to complementarily engage a respective first connector of the at least one first connector to removably couple the housing to the frame.

Aspect 59: The lower receiver according to aspect 58, wherein the lower receiver is in an assembled state when coupled to the magazine well assembly and in an unassembled state when the lower receiver is not coupled to the magazine well assembly.

Aspect 60: The lower receiver according to aspect 59, wherein the lower receiver is incapable of receiving a magazine in the unassembled state.

Aspect 61: The combination according to aspect 58, wherein the magazine well assembly further comprises a latch, the latch movable between a first position in which the latch is configured to engage a magazine to fix the magazine within the magazine receiving space, and a second position in which the latch does not engage the magazine, thereby permitting removal of the magazine from the magazine receiving space.

Aspect 62: The combination according to aspect 61, wherein the latch comprises a lever having a first end and a second end, the lever pivotally coupled to the housing between the first end and the second end.

Aspect 63: The combination according to aspect 62, wherein the latch is pivotally coupled to the housing via a pin, the pin configured to rotate about a first axis, the latch configured to pivot about the first axis.

Aspect 64: The combination according to aspect 62, wherein the housing has an exterior surface and defines an opening extending from the exterior surface to the magazine receiving space, wherein the latch comprises a first engagement surface proximate to the first end, the first engagement surface comprising a projection configured to extend through the opening in the housing and into the magazine receiving space to lock with a second engagement surface on the magazine when the latch is in the first position.

Aspect 65: The combination according to aspect 62, wherein the latch further comprises a spring acting between the housing and the lever, the spring pre-loaded to bias the second end of the lever away from the housing to pivot the latch to the first position, wherein a force acting on the second end compresses the spring to pivot the latch to the second position.

Aspect 66: The combination according to aspect 58, wherein each second connector of the at least one second connector is a female dovetail defined within an exterior surface of the housing, wherein each first connector of the at least one first connector is a male dovetail projection from the frame, and wherein each second connector of the at least one second connector is configured to complementarily receive and engage a respective first connector of the at least one first connector.

Aspect 67: The combination according to 58, wherein the lower receiver is configured to connect to the magazine well by sliding the male dovetail in a direction transversely to a longitudinal axis of the lower receiver to engage the respective female dovetail.

Aspect 68: The combination according to aspect 58, wherein the frame defines an opening adapted to receive a bolt catch assembly.

Aspect 69: The combination according to aspect 68, wherein the magazine well assembly further comprises an insert in an upper exterior surface of the housing, the insert configured to receive a fastener associated with the bolt catch assembly to couple the bolt catch assembly to the housing and restrict movement of the magazine well assembly relative to the lower receiver.

Aspect 70: The combination according to aspect 58, wherein the frame is configured to couple with an upper receiver.

Aspect 71: The combination according to aspect 70, wherein the upper receiver comprises a locking arm, and the housing comprises an upper exterior surface defining a recess configured to receive the locking arm.

Aspect 72: A firearm comprising the combination according to aspect 58; and an upper receiver configured to couple to the lower receiver and the magazine well assembly.

What is claimed is:

1. A lower receiver for a firearm, said lower receiver comprising:

a frame, wherein said frame does not comprise a magazine well; and at least one connector configured to connect to a magazine well assembly that is configured to receive a predetermined type of magazine, thereby permitting replacement of a first magazine well assembly that is configured to receive a first type of magazine with a second magazine well assembly that is configured to receive a second type of magazine; and a bolt catch assembly positionable within said frame, said bolt catch assembly comprising a retaining feature configured to interface with said magazine well assembly.

2. The lower receiver according to claim 1, wherein said lower receiver is in an assembled state when coupled to said magazine well assembly and in an unassembled state when said lower receiver is not coupled to said magazine well assembly, wherein said lower receiver is incapable of receiving a magazine in said unassembled state.

3. The lower receiver according to claim 1, wherein said lower receiver is configured to connect to said magazine well assembly by sliding a first connector of said at least one connector in a direction transversely to a longitudinal axis of said lower receiver to engage said magazine well assembly.

4. The lower receiver according to claim 1, wherein each connector of said at least one connector is a male dovetail projecting from said frame, said male dovetail configured to complementarily insert into and engage a respective female dovetail defined within a housing of said magazine well assembly.

5. The lower receiver according to claim 4, wherein said lower receiver is configured to connect to said magazine well assembly by sliding said male dovetail in a direction transversely to a longitudinal axis of said lower receiver to engage said respective female dovetail.

6. In combination, a lower receiver and a magazine well assembly for a firearm, said lower receiver comprising:

a frame defining an opening adapted to receive a bolt catch assembly, wherein said frame does not comprise a magazine well; and at least one first connector configured to connect to said magazine well assembly, wherein said magazine well assembly is configured to receive a predetermined type of magazine;

said magazine well assembly comprising:

a housing defining a magazine receiving space adapted to receive said predetermined type of magazine, said housing comprising a retaining feature configured to attach to said bolt catch assembly, said housing comprising at least one second connector configured to complementarily engage a respective first connector of said at least one first connector to removably couple said housing to said frame.

7. The lower receiver according to claim 6, wherein said lower receiver is in an assembled state when coupled to said magazine well assembly and in an unassembled state when said lower receiver is not coupled to said magazine well assembly.

8. The lower receiver according to claim 7, wherein said lower receiver is incapable of receiving a magazine in said unassembled state.

9. The combination according to claim 6, wherein said magazine well assembly further comprises a latch, said latch movable between a first position in which said latch is configured to engage a magazine to fix said magazine within said magazine receiving space, and a second position in which said latch does not engage said magazine, thereby permitting removal of said magazine from said magazine receiving space.

10. The combination according to claim 9, wherein said latch comprises a lever having a first end and a second end, said lever pivotally coupled to said housing between said first end and said second end.

11. The combination according to claim 10, wherein said latch is pivotally coupled to said housing via a pin, said pin configured to rotate about a first axis, said latch configured to pivot about said first axis.

12. The combination according to claim 10, wherein said housing has an exterior surface and defines an opening extending from said exterior surface to said magazine receiving space, wherein said latch comprises a first engagement surface proximate to said first end, said first engagement surface comprising a projection configured to extend through said opening in said housing and into said magazine receiving space to lock with a second engagement surface on said magazine when said latch is in said first position.

13. The combination according to claim 10, wherein said latch further comprises a spring acting between said housing and said lever, said spring pre-loaded to bias said second end of said lever away from said housing to pivot said latch to said first position, wherein a force acting on said second end compresses said spring to pivot said latch to said second position.

14. The combination according to claim 6, wherein each second connector of said at least one second connector is a female dovetail defined within an exterior surface of said housing, wherein each first connector of said at least one first connector is a male dovetail projection from said frame, and wherein each second connector of said at least one second connector is configured to complementarily receive and engage a respective first connector of said at least one first connector.

15. The combination according to 14, wherein said lower receiver is configured to connect to said magazine well by sliding said male dovetail in a direction transversely to a longitudinal axis of said lower receiver to engage said respective female dovetail.

16. The combination according to claim 6, wherein said retaining feature comprises an insert in an upper exterior surface of said housing, said insert configured to receive a fastener associated with said bolt catch assembly to couple said bolt catch assembly to said housing and restrict movement of said magazine well assembly relative to said lower receiver.

17. The combination according to claim 6, wherein said frame is configured to couple with an upper receiver.

18. The combination according to claim 17, wherein said upper receiver comprises a locking arm, and said housing comprises an upper exterior surface defining a recess configured to receive said locking arm.

19. A firearm comprising:

a bolt catch assembly;

a lower receiver comprising:

a frame defining an opening adapted to receive said bolt catch, wherein said frame does not comprise a magazine well, and at least one first connector;

a magazine well assembly configured to receive a predetermined type of magazine, said magazine well assembly comprising a housing defining a magazine receiving space adapted to receive said predetermined type of magazine, said housing comprising at least one second connector configured to complementarily engage a respective first connector of said at least one first connector to removably couple said housing to said frame, said housing configured to couple to said bolt catch assembly; and an upper receiver configured to couple to said lower receiver and said magazine well assembly.

* * * * *